US008385779B2

(12) United States Patent
Takishita

(10) Patent No.: US 8,385,779 B2
(45) Date of Patent: Feb. 26, 2013

(54) CHARGING DEVICE INCLUDING A MULTI-PORTION SHEET MEMBER FOR SHIELDING A CORONA CHARGER

(75) Inventor: Shigeki Takishita, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 291 days.

(21) Appl. No.: 12/793,857

(22) Filed: Jun. 4, 2010

(65) Prior Publication Data

US 2010/0322668 A1 Dec. 23, 2010

(30) Foreign Application Priority Data

Jun. 17, 2009 (JP) ..... 2009-144339

(51) Int. Cl.
*G03G 15/02* (2006.01)

(52) U.S. Cl. ..... 399/170; 399/168; 399/172

(58) Field of Classification Search ..... 399/115, 399/169, 170

See application file for complete search history.

(56) References Cited

U.S. PATENT DOCUMENTS

| | | | | |
|---|---|---|---|---|
| 4,728,991 | A * | 3/1988 | Takayama et al. | 347/140 |
| 5,504,560 | A * | 4/1996 | Kitagaki et al. | 399/168 |
| 7,315,719 | B2 * | 1/2008 | Wagner et al. | 399/297 |
| 2008/0038011 | A1 * | 2/2008 | Nakajima et al. | 399/100 |
| 2010/0111554 | A1 * | 5/2010 | Kidaka | 399/66 |
| 2010/0158550 | A1 * | 6/2010 | Makino et al. | 399/45 |

FOREIGN PATENT DOCUMENTS

| | | | |
|---|---|---|---|
| JP | 2003-76118 A | | 3/2003 |
| JP | 2003076118 A | * | 3/2003 |
| JP | 2007-72212 A | | 3/2007 |
| JP | 2009-128617 A | | 6/2009 |

OTHER PUBLICATIONS

Communication and European Search Report dated Oct. 11, 2010, in counterpart European Application No. 10166179.1-2209.

Notification of the First Office Action dated Sep. 15, 2011, in Chinese Application No. 201010205929.X.

* cited by examiner

*Primary Examiner* — David Gray
*Assistant Examiner* — Tyler Hardman
(74) *Attorney, Agent, or Firm* — Fitzpatrick, Cella, Harper & Scinto

(57) ABSTRACT

A charging device includes a corona charger for electrically charging a photosensitive member; a shutter, having first surfaces at which the shutter opposes the corona charger and having second surfaces at which the shutter opposes the photosensitive member, for covering and uncovering an opening of the corona charger with respect to a longitudinal direction of the opening; and a retracting device for retracting the shutter when the opening is uncovered. The retracting device retracts the shutter in a state in which the first surfaces contact each other so that the first surfaces and the second surfaces do not contact each other.

3 Claims, 10 Drawing Sheets

CHARGING DEVICE INCLUDING A MULTI-PORTION SHEET MEMBER FOR SHIELDING A CORONA CHARGER

FIELD OF THE INVENTION AND RELATED ART

The present invention relates to a charging device and an image forming apparatus including the charging device.

In the image forming apparatus of an electrophotographic type, as a charging means for electrically charging a photosensitive member, a corona charger (primary charger) has been used. Specifically, the corona charger is disposed opposed to the photosensitive member in a non-contact manner and a surface of the photosensitive member is electrically charged uniformly to a predetermined polarity and a predetermined potential by corona ions generated by corona discharge of the corona charger. Such a corona charger includes a discharging wire as a charging electrode in a box-like shielding electrode (casing) formed so that a substantially rectangular surface is exposed, and causes the corona discharge by applying a voltage to the discharging wire while grounding the shielding electrode.

Such a corona discharger generates electric discharge products such as ozone ($O_3$) or nitrogen oxides (NOx) during an operation thereof. These electric discharge products act on discharging energy, ambient gas, ambient moisture, and the like, so that hydrophilic compounds such as a nitrogen compound and compounds having aldehyde group, carboxyl group, hydroxyl (OH) group, and the like are deposited on the photosensitive member surface. The deposited compound (hereinafter referred to as the electric discharge product) absorbs the ambient moisture and as a result, a surface resistance of the photosensitive member is lowered, so that a so-called "image deletion (image flow" or "image blur" phenomenon by which an electrostatic latent image is lacking is caused to occur in some cases. Specifically, this phenomenon occurs in the case the electric discharge product gradually deposited in the corona charger (in the casing) during an image forming operation is deposited in a band-like shape on the photosensitive member below the charger and absorbs the moisture.

Such "image flow" and "image blur" occur due to the moisture absorption of the electric discharge product which is the hydrophilic compound deposited on the photosensitive member. Therefore, it is considered that the electric discharge product is prevented from absorbing the moisture by increasing a surface temperature of the photosensitive member to a level not less than an ambient temperature. Specifically, it is considered that a constitution in which a heater is disposed at an inner surface of the photosensitive member (hereinafter, the heater is referred to as a "drum heater" to heat the photosensitive member, thereby to prevent the moisture absorption of the electric discharge product is employed. However, in the constitution in which the photosensitive member is always heated by the drum heater, electric power consumed by the image forming apparatus is undesirably increased.

As another method, a method of removing the electric discharge product itself deposited on the photosensitive member surface is considered. Specifically, a constitution in which the electric discharge product deposited on the photosensitive member is removed by a cleaning blade or the like which contacts the photosensitive member is considered. However, in such a constitution, there is the need to rotate.the photosensitive member for several minutes in order to remove the electric discharge product deposited during standing of the photosensitive member for a long term. For that reason, a time required from a sleep state of the image forming apparatus to output of a first sheet to be copied (first copy out time (FCOT)) is increased.

In view of this problem, Japanese Laid-Open Patent Application (JP-A) 2007-72212 discloses a structure for preventing falling of a matter to be deposited from the charger onto the photosensitive member by inserting a shielding member (shutter) between the charger and the photosensitive member during long-term rest. Specifically, during the long-term rest, the shielding member is located at a shielding position to prevent the electric discharge product from being deposited on the photosensitive member. As a result, the constitution described in JP-A 2007-72212 can suppress the electric power consumed by the apparatus compared with the constitution using the drum heater and can shorten the FCOT compared with the constitution in which the photosensitive member is rotated for the long term.

However, in the case of the structure described in JP-A 2007-72212, the shielding member is moved in a tangential direction of the photosensitive member, there is a retraction position of the charger at a periphery of the photosensitive member. At the periphery of the photosensitive member, in addition to the charger, various devices such as an exposure device, a developing device and a cleaning device are disposed, so that the apparatus is increased in size in the case where the retraction position as described above is ensured. Incidentally, in order to avoid the periphery of the photosensitive member where the various devices are disposed, even when the retraction deposit is located at a position deviated from the various devices with respect to the longitudinal direction of the photosensitive member, the size of the resultant apparatus is also increased.

In view of this problem, it is considered that the shielding member is formed in a sheet-like shape and the shielding member is wound up to be retracted from a gap between the charger and the photosensitive member. By employing such a constitution, even when a sheet winding-up means is disposed at a position deviated (from the various devices) with respect to the longitudinal direction of the photosensitive member, it is possible to suppress the increase in size of the apparatus. However, in the case of such a constitution, during the winding-up, a surface of the sheet on the charger side contacts a surface of the sheet on the photosensitive member side. That is, during the winding-up, the sheet is wound around, e.g., a bobbin but after one-full turn of the bobbin, the sheet is wound in such a manner that the charger-side surface of the sheet is superposed on the photosensitive member-side surface of the sheet, so that the charger-side surface of the sheet contacts the photosensitive member-side surface of the sheet.

In this case, on the sheet surface on the charger side, the electric discharge product has been deposited during the long-term rest, so that the electric discharge product is deposited on the sheet surface on the photosensitive member side. There is a possibility that the electric discharge product deposited on the photosensitive member-side surface of the sheet is transferred onto the photosensitive member by the contact between the photosensitive member-side surface of the sheet and the surface of the photosensitive member when the sheet is inserted into the gap between the charger and the photosensitive member in order to create a shielding state. In the case where the electric discharge product is transferred on the photosensitive member, the image flow or the image blur is caused to occur. Incidentally, it is also considered that the bobbin for winding up the sheet is made large so as to permit the winding-up of the sheet by only one-full turn thereof. However, in this case, the increase in size of the apparatus cannot be avoided.

As a material for the sheet, it is considered that a material for chemically absorbing the electric discharge product, a material for configurationally trapping the electric discharge product or a material such that the electric discharge product is decomposed is used. As an example of such materials, a foamed polyurethane sheet having a porous surface is used. It has been confirmed that the polyurethane sheet is less liable to cause the transfer of the electric discharge product once deposited on the sheet. However, the polyurethane sheet is low in flame resistance, so that it is not preferable that such a material is used in the neighborhood of the charger.

As the material used in the neighborhood of the charger, a material which has a resistance to chemicals such as acid, alkali and a hydrocarbon solvent and has high flame resistance and such a physical property such that it has a high mechanical performance (such as a high strength) even in a sheet-like shape. As such a material, it is possible to use, e.g., chemically stable resin materials such as polyamide resin, polyimide resin, polyphenylene sulfide resin, polycarbonate resin, polyethylene terephthalate resin, phenolic resin, and aramide resin. However, such a resin material-made sheet is weak in depositing force of the deposited electric discharge product, so that the electric discharge product is liable to be transferred therefrom.

The present inventor conducted the following experiment by using such a resin material-made sheet. That is, the electric discharge product was deposited on the sheet surface and then was subjected to the electric discharge. Then, after the front sheet surface and the rear sheet surface were superposed and were left standing for some time, the sheet was left standing overnight in a state in which the rear surface of the sheet contacted the surface of the photosensitive member. Thereafter, when image formation was effected by using the photosensitive member, the image flow occurred. As a result, in the case where the above-described material was used, it was found that the electric discharge product was transferred from the front surface of the sheet onto the rear surface of the sheet and then was transferred from the rear surface of the sheet onto the surface of the photosensitive member.

SUMMARY OF THE INVENTION

A principal object of the present invention is to provide a charging device having solved the above-described problems.

According to an aspect of the present invention, there is provided a charging device comprising:

a corona charger for electrically charging a photosensitive member;

a shutter, having first surfaces at which the shutter opposes the corona charger and having second surfaces at which the shutter opposes the photosensitive member, for covering and uncovering an opening of the corona charger with respect to a longitudinal direction of the opening; and a retracting device for retracting the shutter when the opening is uncovered, wherein the retracting device retracts the shutter in a state in which the first surfaces contact each other so that the first surfaces and the second surfaces do not contact each other.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

[First Embodiment]

Figure 1:
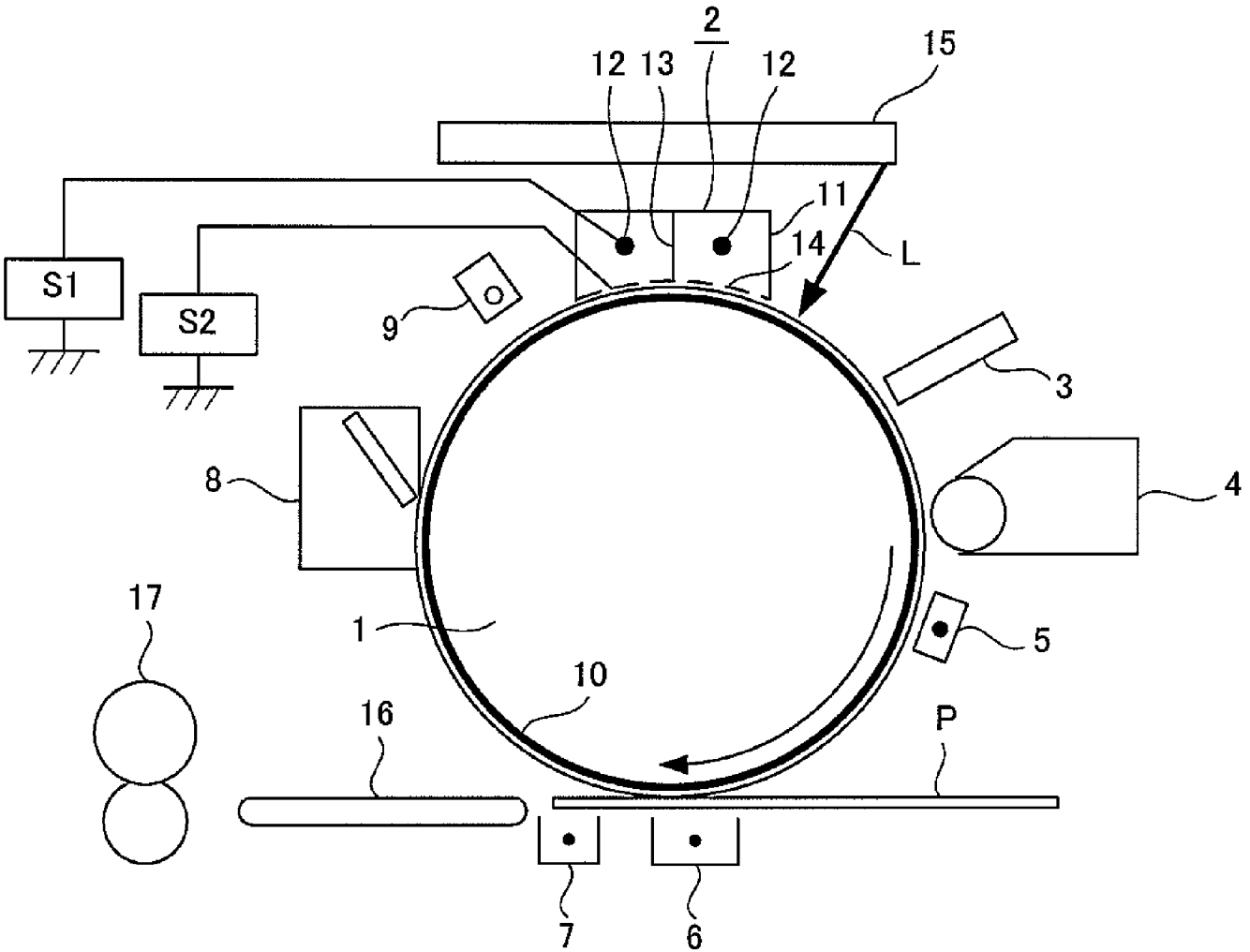
FIG. 1 is a schematic view showing a structure of a photosensitive drum of an image forming apparatus according to the present invention and the neighborhood thereof.
Figure 2:
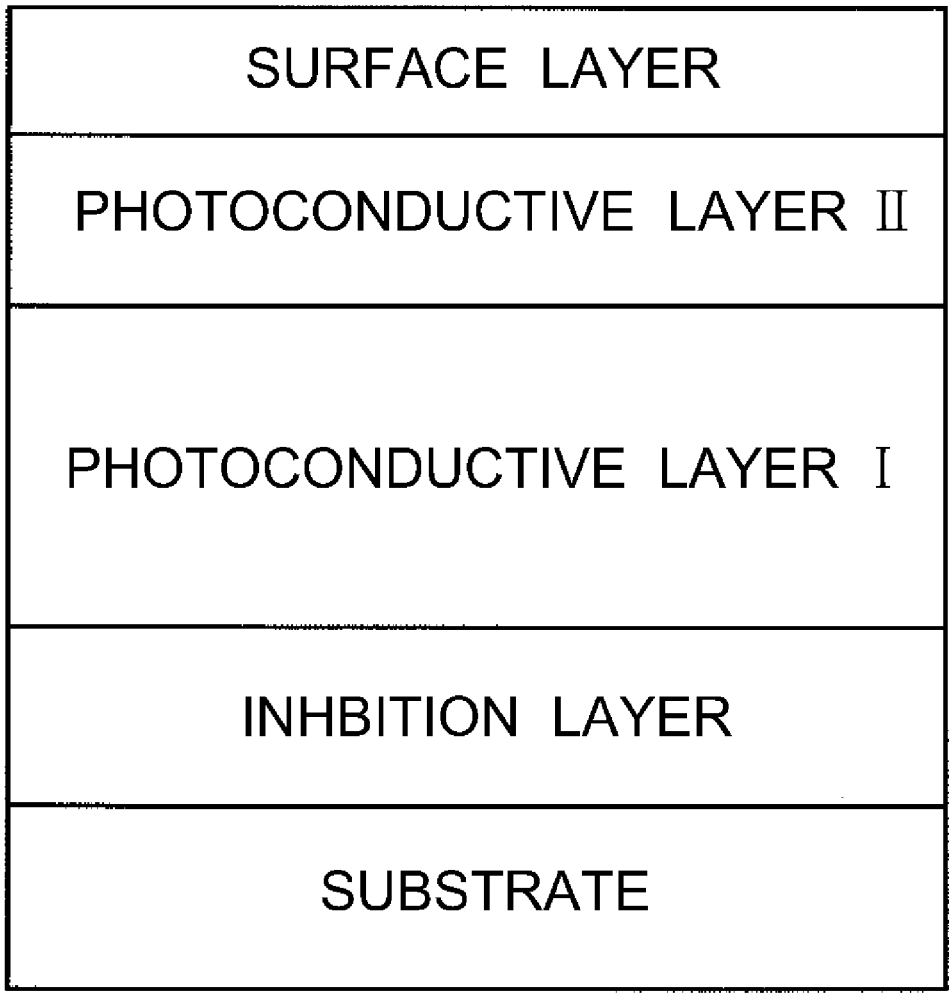
FIG. 2 is a schematic view showing a sectional layer structure of the photosensitive drum.

FIGS. 1 to 5 and FIGS. 6(*a*) to 6(*c*) illustrate First Embodiment. First, with reference to FIG. 1, an image forming apparatus of an electrophotographic type, such as a laser beam printer, a copying machine or a facsimile machine, according to the present invention will be described. The image forming apparatus includes a photosensitive drum 1 as a photosensitive member to be rotationally driven at a predetermined peripheral speed (process speed) in a direction indicated by an arrow (clockwise direction) by drive of a driving device (not shown). Around the photosensitive drum 1, along the rotational direction of the photosensitive drum 1, devices including a primary charger 2, a potential sensor 3, a developing device 4, a pre-exposure charger 5, a transfer charger 6, a separation charger 7, a cleaning device 8, and a discharging example lamp 9 are disposed. The photosensitive drum 1 has a diameter of 80 mm and is contacted by a photoconductive layer of a-Si (amorphous silicon). That is, the photosensitive drum 1 is, as shown in FIG. 2, constituted by successively laminating, on a cylindrical support of an electroconductive material of aluminum, an inhibition layer, a photoconductive layer I, a photoconductive layer II and a surface layer. Each of the photoconductive layers (I and II) is formed principally of an amorphous silicon material containing silicon, hydrogen and halogen. Inside the photosensitive drum 1, a drum heater 10 is provided and in an environment in which an absolute water (moisture) content in the air is not less than a certain volume, the drum heater 10 is turned on for energization during sheet passing. As a result, the photosensitive drum 1 surface is heated to prevent the deposition of the electric discharge product on the photosensitive drum 1. Incidentally, the drum heater 10 is not turned on during the long-term rest.

The surface of the photosensitive drum 1 is charged to a predetermined polarity and a predetermined potential by the primary charger 2. This primary charger 2 is a corona charger for causing corona electric discharge by providing a wire 12 in a box-like shielding electrode (casing) 11 formed so as to expose one substantially rectangular surface and by applying a charging bias from a power source Si to the wire 12 while grounding the casing 11. In the case of the example shown in FIG. 1, two wires 12 are provided and a shielding plate 13 is provided between the two wires 12. Further, in this embodiment, as the primary charger 2, a scorotron including a grid electrode 14 disposed at an opening of the casing 11 is used. Such a primary charger 2 is disposed opposed to the photosensitive drum 1 in a non-contact manner and charges the photosensitive drum 1 surface to the predetermined potential by applying the charging bias from a power source Si to the wire 12 and applying a grid bias from a power source S2 to the grid electrode 14.

The charged surface of the photosensitive drum 1 is subjected to image exposure to light L corresponding to image information by an exposure device 15. As a result, the surface potential of the photosensitive drum 1 is lowered at the exposed portion, so that an electrostatic latent image corresponding to the input image information is formed on the photosensitive drum 1. Further, the surface potential of the charged photosensitive drum 1 is measured by a potential sensor 3. Then, on the basis of the measured potential, an amount of charge by the primary charger 2 is controlled. The electrostatic latent image formed on the photosensitive drum 1 surface by the exposure device 15 is visualized as a toner image by depositing toner, charged to an identical polarity to the charge polarity of the photosensitive drum 1, by the developing device 4. Then, the toner image is further enhanced in charge polarity by the pre-exposure charger 5 and thereafter is transferred onto a recording material P with predetermined timing by applying a transfer bias, of an opposite polarity to the toner charger potential, to the transfer charger 6. Incidentally, the transfer onto the recording material P is also performed by a transfer roller in some cases.

The recording material P on which the toner image is transferred is separated from the photosensitive drum 1 by being charge-removed by the separation charger 7. Thereafter, the recording material P is conveyed to a fixing device 17 by a conveying device 16. Then, the toner image is heated and pressed by the fixing device 17 to be fixed on the recording material P and thereafter the recording material P is discharged to the outside of the apparatus. Separately, transfer residual toner remaining on the photosensitive drum 1 surface after the toner image transfer is removed and collected by the cleaning device 8. Further, residual charges on the photosensitive drum 1 surface are removed by the discharging exposure lamp 9, so that the photosensitive drum 1 prepares for a subsequent image forming operation.

In this embodiment, the pre-transfer charger 5, the transfer charger 6, and the separation charger 7 are also the corona chargers similarly as the primary charger 2. All or at least one of these corona charger is provided with a shielding member 18 described below. The shielding member 18 shields a gap between the photosensitive drum 1 and the corona charger to prevent the electric discharge product generated by the corona charger from depositing on the surface of the photosensitive drum 1. Incidentally, the shielding member 18 may particularly preferably be provided on the corona charger disposed on an upper side of the photosensitive drum 1 is an apparatus disposition state. Hereinbelow, a charging device including the primary charger (hereinafter simply referred to as the "charger") to which the sheet 18 and a driving means 19 are provided will be described as a representative example with reference to FIGS. 3, 4, 5 and 6(*a*) to 6(*c*).

Figure 3:
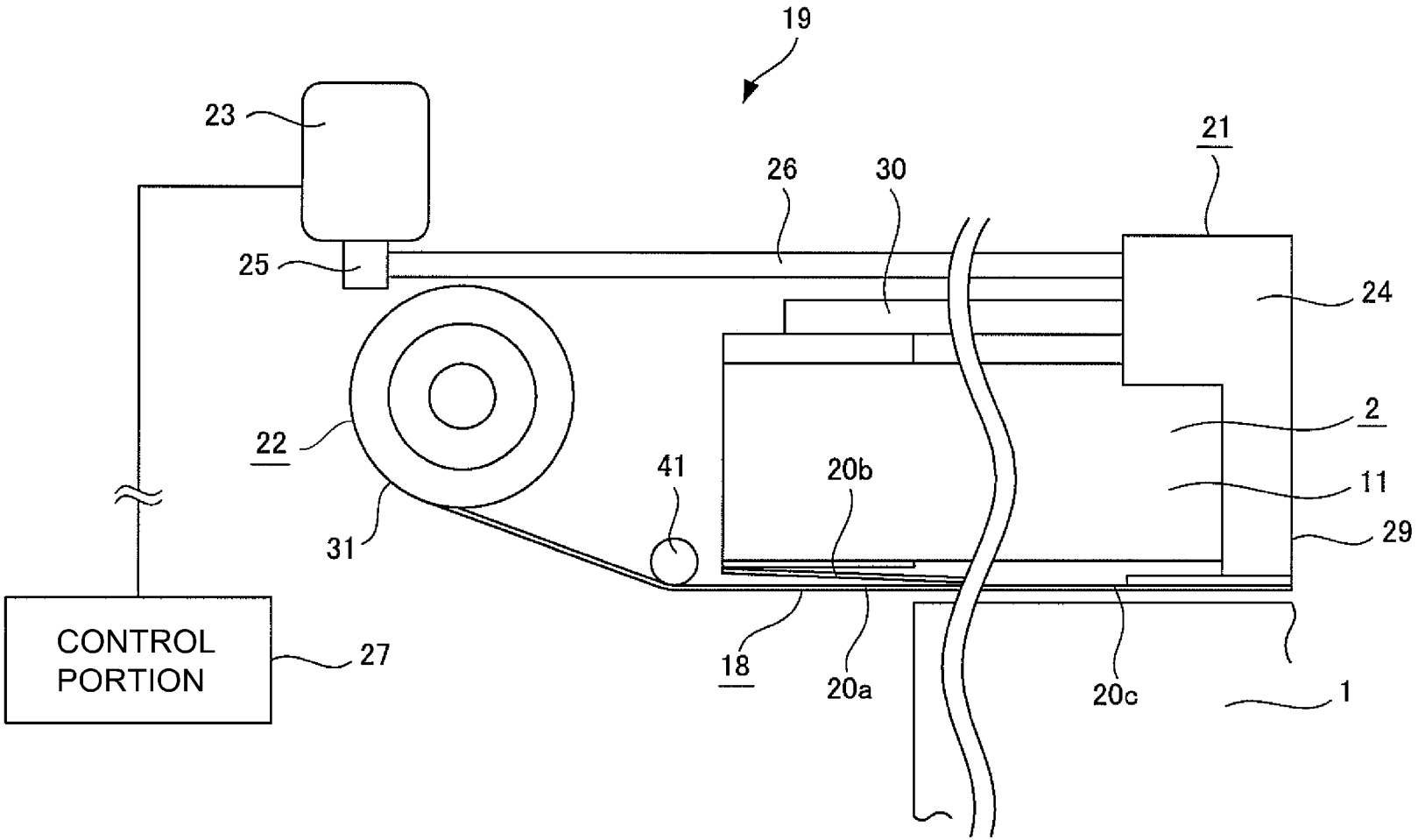
FIG. 3 is a schematic structural view showing a charging device in First Embodiment.
Figure 5:
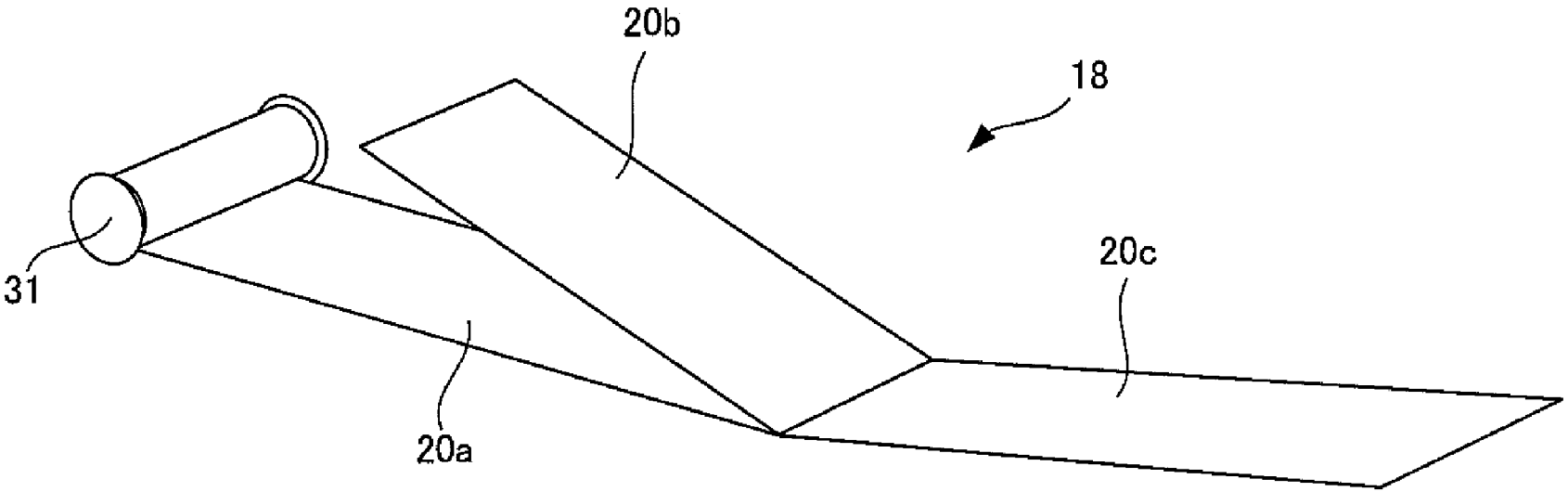
FIG. 5 is a perspective view showing a schematic structure of a winding-up means and a shielding member.

In this embodiment, as shown in FIG. 3, the shielding member 18 for shielding the gap between the photosensitive drum 1 and the charger 2 is formed with a sheet-like member, and the sheet-like member is capable of being wound up in a longitudinal direction of the photosensitive drum 1 by the driving means 19. This sheet-like member, as shown in FIG. 5, e.g., formed in a substantially Y-character shape as a whole by bonding an end (edge) of a sheet to a longitudinal intermediate portion of a sheet. Therefore, the sheet-like member is consisting of a first sheet portion 20*a*, a second sheet portion 20*b* and a third sheet portion 20*c*. In this embodiment, the first sheet portion 20*a* and the third sheet portion 20*c* constitute the sheet. To the intermediate portion of this sheet, i.e., to a portion where ends of the first sheet portion 20*a* and the third sheet portion 20*c* are connected with each other, the end of the second sheet portion 20*b* is bonded. Each of these sheet portions 20*a*, 20*b* and 20*c* has the same width. Further, as a material for the sheet-like member consisting of the sheet portions 20*a*, 20*b* and 20*c*, a material which has a resistance to chemicals (is chemically stable) and a high flame resistance and also has a physical property such that a mechanical performance (such as a strength) is high even in the form of a thin sheet is used. For example, a 30 μm-thick ethylene-vinyl acetate (copolymer) sheet is used. The sheet consisting of the first sheet portion 20*a* and the third sheet portion 20*c* has a length of, e.g., 50 mm which his somewhat longer than a length (e.g., 44 mm) of the opening of the casing 11 of the charger 2.

Further, the shielding member 18 is constituted by the second sheet portion 20*b* and the third sheet portion 20*c* of the first to third sheet portions 20*a* to 20*c*, and the first sheet portion 20*a* constitutes a winding-up means 22 described later. Therefore, the shielding member 18 covers the opening of the casing 11 of the charger 2 with the second sheet portion 20*b* and the third sheet portion 20*c*. Further, the shielding member 18 is divided into the second sheet portion 20*b* and the third sheet portion 20*c* so that the second and third sheet portions 20*b* and 20*c* constitute a pair with respect to the longitudinal direction thereof. An end of the second sheet portion 20*b*, i.e., a base end of the shielding member 18 is fixed at an end portion of the charger 2 on one longitudinal end side (left side in FIGS. 3, 6(*a*), 6(*b*) and 6(*c*)) or fixed at a fixing portion, on the one longitudinal end side (a portion fixed on the charger 2), located toward the end of the charger than the end portion of the charger. Further, a base end of the first sheet portion 20*a* is connected to the longitudinal central portion of the shielding member 18 constituted by the second sheet portion 20*b* and the third sheet portion 20*c*. Incidentally, the length of each of the sheet portions 20*a* to 20*c* is determined in consideration of a winding-up amount of the winding-up means 22 or a locating position of the winding-up means 22. That is, the lengths of the sheet portions 20*a* to 20*c* are only required that the opening of the casing 11 of the charger 2 can be covered with the second sheet portion 20*b* and the third sheet portion 20*c* and that the surface of the third sheet portion 20*c* can be substantially covered with the second sheet portion 20*b* during the winding up. Therefore, when such a requirement is satisfied, the portion where the end of the first sheet portion 20*a* is bonded may be located at any portion within a predetermined longitudinal range (the longitudinal intermediary portion) including the longitudinal central portion of the shielding member 18.

Further, the driving means 19 includes a movable means 21 and the winding-up means 22. Of these means, the movable means 21 is provided with a motor 23 disposed at the end portion of the charger 2 on the one longitudinal end side of the charger and disposed on a side opposite from the photosensitive drum 1 through the charger 2, and is provided with a movable member 24 movable in the longitudinal direction of the charger 2. On a rotation shaft of the motor 23, a worm 25 is fixed, and a lead screw 26 rotatable by engagement with the worm 25 is disposed longitudinally opposed to the photosensitive drum 1 through the charger 2. On the lead screw 26, an interval (female) screw portion 28 provided in the movable member 24 is threadably mounted. Therefore, when the worm 25 is rotated by instructions from a control portion 27, a rotational force by the rotation is transmitted to the lead screw 26, so that the lead screw 26 is rotated. Then, by engagement with the lead screw 26, the movable member 24 is moved along the lead screw 26 between both longitudinal end portions of the charger 2. Incidentally, the mechanism for moving the movable member 24 may also be another mechanism, different from the above-described mechanism, such as a rack-and-pinion mechanism. In the case of the rack-and-pinion mechanism, it is considered that such a structure that the pinion and a driving source for driving the pinion are provided to the movable member 24 and the rack is disposed longitudinally at a position of the lead screw 26 is used.

Further, the movable means 21 also moves a cleaner as a removing means for removing a foreign matter deposited on the wire 12 of the charger 2 (a cleaning means for cleaning the wire 12 of the charger 2). That is, a structure for moving along the wire 12 the cleaner for removing the deposited matter in order to prevent deterioration of electric discharge uniformity caused due to the deposition on the wire 12 is used. Therefore, when the movable means 21 also has the function of moving such a cleaner, there is no need to separately provide the means for moving the end of the shielding member 18, so that the structure which has already been provided is usable.

Figure 4:
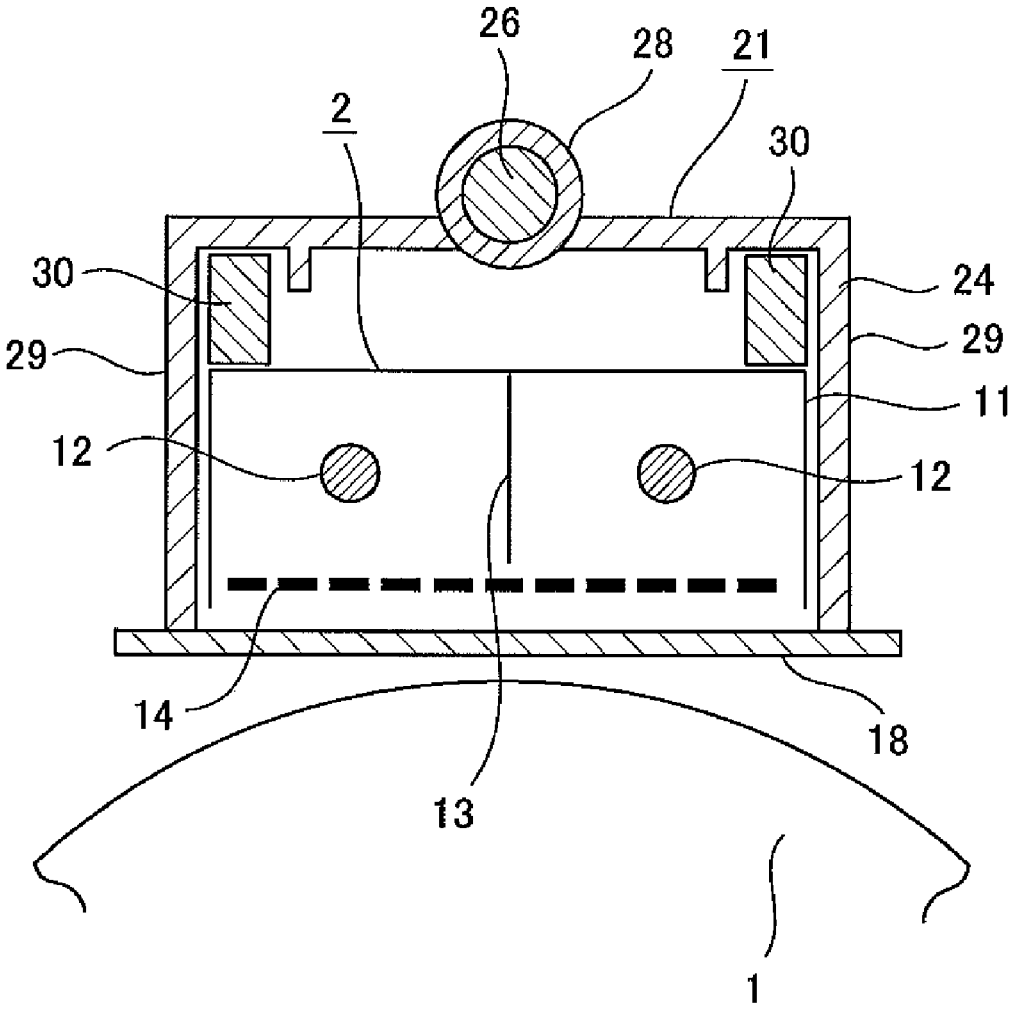
FIG. 4 is a sectional view of the charging device.

The movable member is, as shown in FIG. 4, constituted by the internal screw portion 28 disposed opposed to the photosensitive drum 1 through the charger 2 and by a pair of arm portions 29 extended from the internal screw portion 28 so as to cover the charger 2. The both end portions 29 are mounted on a rail 30 provided and extended longitudinally on the charger 2 so as to be opposed to the photosensitive drum 1 through the charger 2. Therefore, by the rotation of the lead screw 26, the movable member 24 is moved along the rail 30. Further, the both arm portions 29 is extended toward the photosensitive drum 1 side when compared with the charger 2. At ends of the both arm portions 29, the end of the shielding member 18, i.e., the end of the third sheet portion 20*c* is fixed. Therefore, the end of the shielding member 18 is moved in the longitudinal direction of the charger 2 together with the movable member 24.

The winding-up means 22 is disposed outside the one longitudinal portion of the charger and includes a bobbin 31 in which a power (main) spring is disposed. The winding-up means 22 is constituted so that the bobbin 31 is rotated by a tension of the power spring. Incidentally, such a winding-up means 22 may also be constituted so that the bobbin 31 is rotated, e.g., by utilizing a driving force of the motor 23 or separately providing a motor. On the bobbin 31 which is rotated in such manners, the end of the first sheet portion 20*a* is fixed. Therefore, when the bobbin 31 is rotate in, e.g., a clockwise direction in FIG. 3, the first sheet portion 20*a* is pulled leftward in FIG. 3. Then, with the movement of the first sheet portion 20*a*, the second sheet portion 20*b* and the third sheet portion 20*c* are pulled leftward from the connecting portion therebetween, i.e., from the longitudinal intermediary portion of the shielding member 18. Incidentally, as shown in FIG. 3, between the bobbin 31 and the casing 11, a guide roller 41 is provided so as to guide the shielding member 18 to be wound up by the bobbin 31.

Figure 6:
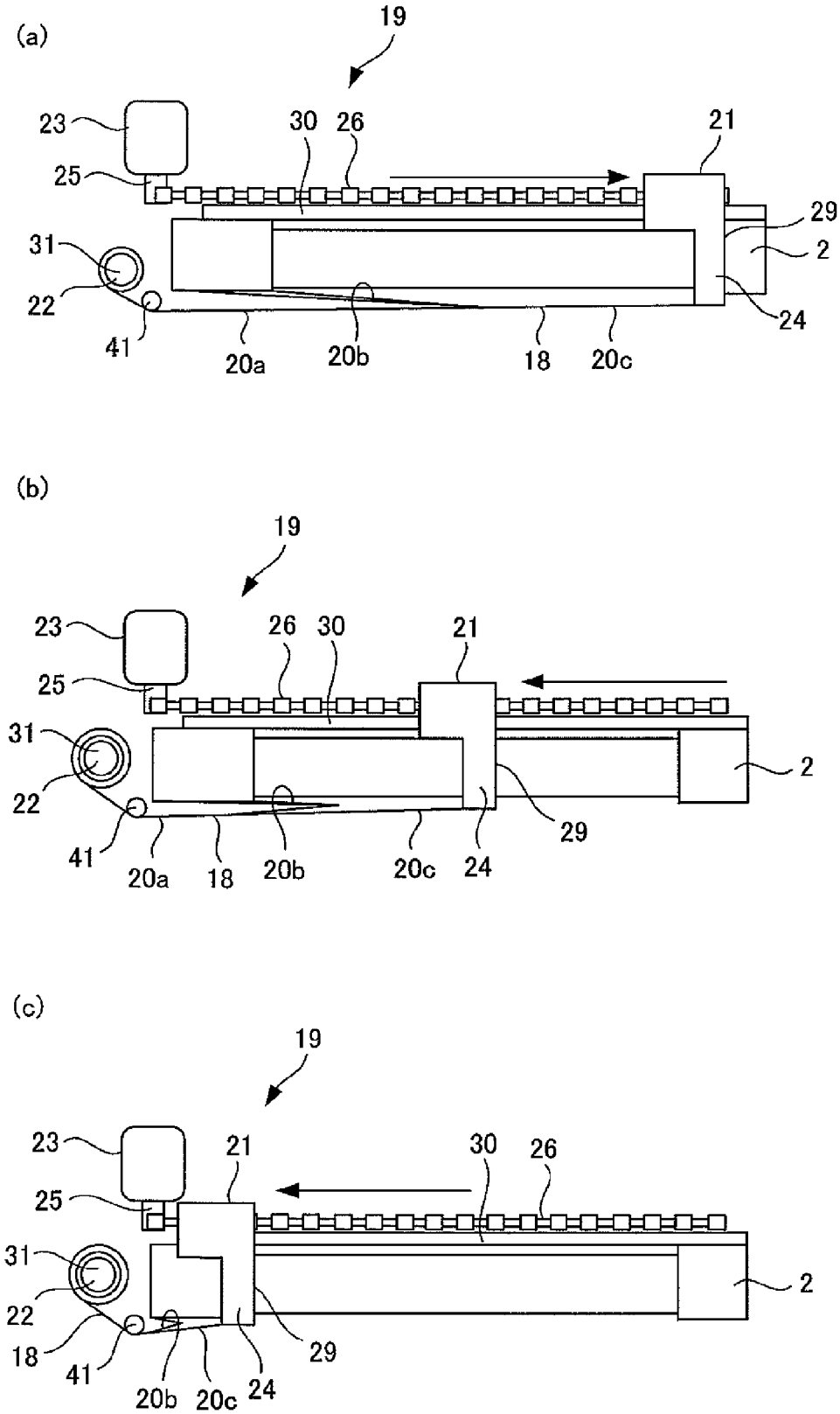
FIGS. 6(*a*) to 6(*c*) are schematic structural views for sequentially illustrating a transition state from a shielding state to a retraction state.
Figure 7:
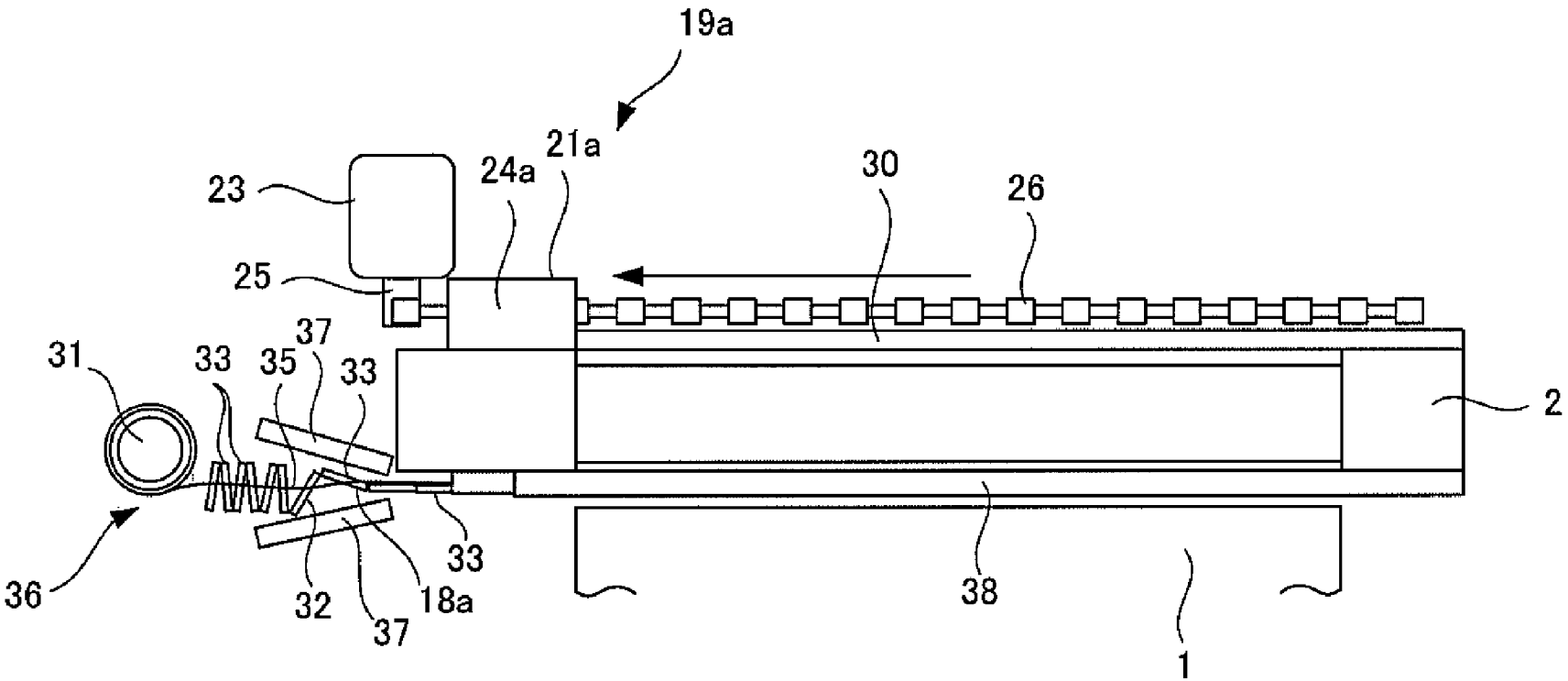
FIG. 7 is a schematic view showing a charging device in Second Embodiment.
Figure 8:
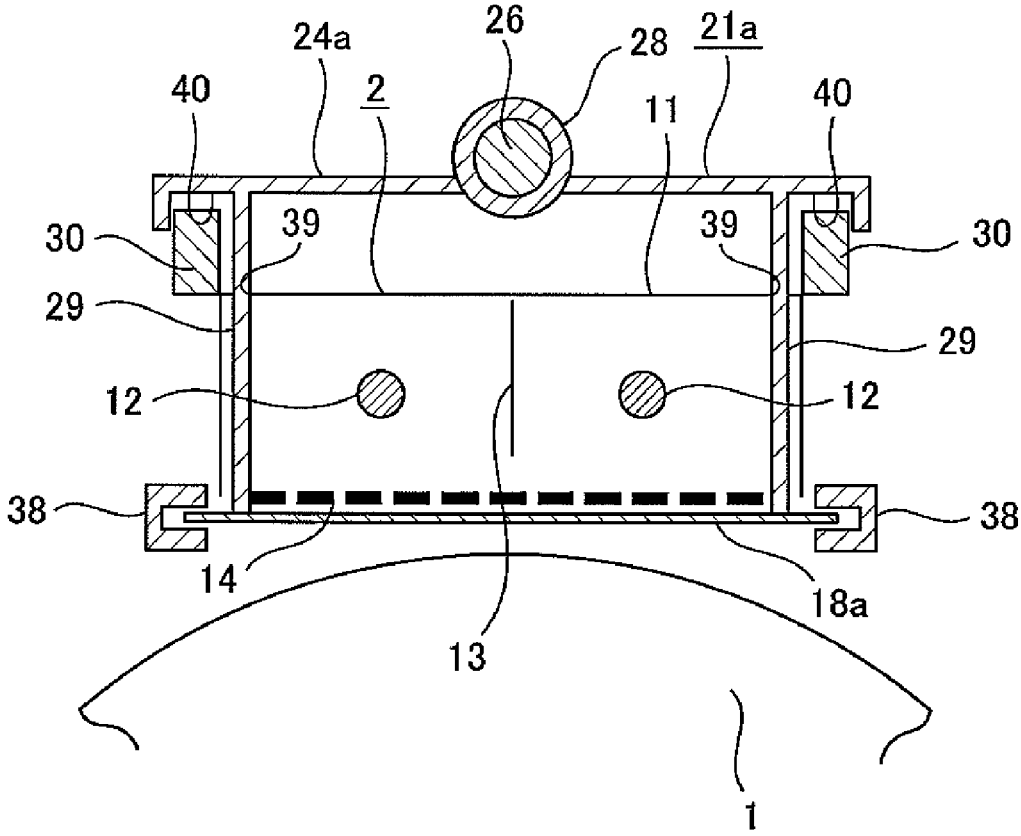
FIG. 8 is a sectional view of the charging device.

In this embodiment, in a shielding state in which the gap between the photosensitive drum 1 and the charger 2 is shielded by the shielding member 18, the lead screw 26 is rotated by the motor 23. Then, as shown in FIG. 6(*a*), the end of the shielding member 18 is moved the other longitudinal end portion side of the charger 2 (right side in FIGS. 3 and 6(*a*) to 6(*c*)). At this time, the shielding member 18 is pulled out from the winding-up means 22 by rotating the bobbin 31 against the tension of the power spring. As a result, the end of the third sheet portion 20*c* which is the end of the shielding member 18 is located outside the other longitudinal end portion of the opening of the casing 11 of the charger 2. The end of the second sheet portion 20*b* which is the base end of the shielding member 18 is fixed at the one longitudinal end portion of the charger 2, so that the surfaces of the second sheet portion 20*b* and the third sheet portion 20*c* oppose the opening of the casing 11. Further, the first sheet portion 20*a* is also pulled out from the winding-up means 22 and is in a state in which it is superposed on the second sheet portion 20*b*. Therefore, the surface of the first sheet portion 20*a* is covered with the second sheet portion 20*b* and thus does not oppose the casing 11. Such a shielding state is created by driving the motor 23 in accordance with instructions from the contact portion 27 in the case where an unshown CPU judges that the present time is the long-term rest period such as the time when the state of the apparatus enters a sleep state.

Then, in a retraction state in which the shielding member 18 is retracted from the gap between the photosensitive drum 1 and the charger 2, the state of the shielding member 18 is successively shifted from the state of FIG. 6(*a*) to a state of FIG. 6(*c*) through a state of FIG. 6(*b*). For example, at the time of rising from the long-term rest period, such as the time of rising from the sleep state, the motor 23 is driven in a direction opposite to that in the case where the state of the shielding member 18 is shifted into the shielding state in accordance with the instructions from the control portion 27. As a result, the lead screw 26 is rotated in the direction opposite to that in the case where the state of the shielding member 18 is shifted into the shielding state, so that the end of the shielding member 18 is moved to the one longitudinal end side of the charger 2. At this time, the bobbin 31 is rotated by the tension of the power spring, so that the first sheet portion 20*a* is pulled. As a result, the shielding member 18 is pulled by the winding-up means 22 from the connecting portion, between the second sheet portion 20*b* and the third sheet portion 20*c*, which is the longitudinal intermediate portion at which the first sheet portion 20*a* is connected to the shielding member 18. Thus, as shown in FIG. 6(*b*), the second sheet portion 20*b* is bent, so that a charging means-side surface of the second sheet portion 20*b* is gradually superposed on a charging means-side surface of the third sheet portion 20*c*. Then, at the time of completion of the winding up, as shown in FIG. 6(*c*), the shielding member 18 is retracted in a state in which the (charging means-side) surfaces of the second sheet portion 20*b* and the third sheet portion 20*c* are substantially superposed on each other. In other words, the shielding member 18 is retracted so that its longitudinal length is shorter than that in the shielding state with the shift (transition) of the retraction state and so that the charging means 2-side surfaces of the second and third sheet portions 20*b* and 20*c* oppose each other.

By winding up the shielding member 18 in the above-described manner, it is possible to prevent the contact between the rear surface and the front surface (the charger means-side surface) of the shielding member 18 wound up by the bobbin 31. That is, when the bobbin 31 is rotated one full turn, the rear surfaces of the first sheet portion 20*a* and the third sheet portion 20*c* as the rear surface of the shielding member 18 are located at an outermost peripheral surface of the bobbin 31. Then, when the bobbin 31 is further rotated, the (charging means-side) surface of the first sheet portion 20*a* first contacts the outermost peripheral surface and then the rear surface of the second sheet portion 20*b* contacts the outer peripheral surface, so that the winding up of the shielding member 18 is completed. For this reason, the surfaces of the second sheet portion 20*b* and the third sheet portion 20*c* which have opposed the charger 2 in the shielding state do not contact the rear surfaces of the first sheet portion 20*a* and the third sheet portion 20*c* which oppose the photosensitive drum 1 in the shielding state.

On the other hand, in the case where the state of the shielding member 18 is shifted into the shielding state, the end of the third sheet portion 20*c* is pulled out from the winding-up means 22 by the movable means 21. At this time, the third sheet portion 20*c* is pulled out while the surface thereof is separated from the surface of the second sheet portion 20*b*. When the third sheet portion 20*c* is further pulled out, the second sheet portion 20*b* is pulled out while being deformed so as cover the surface of the first sheet portion 20*a*. Then, the shielding member 18 is placed in the above-described shielding state. Thus, also when the shielding member 18 is pulled out from the winding-up means 22, the surfaces of the second sheet portion 20*b* and the third sheet portion 20*c* do not contact the rear surfaces of the first sheet portion 20*a* and the third sheet portion 20*c*.

According to this embodiment, with the transition to the retraction state, the shielding member 18 is retracted so that the surfaces of the second sheet portion 20*b* and the third sheet portion 20*c* obtained by longitudinally dividing the shielding member 18 into two sections oppose each other, so that the increase in size of the apparatus can be suppressed. Further, the surfaces of the second sheet portion 20*b* and the third sheet portion 20*c* of the shielding member 18 do not contact the rear surfaces of the first sheet portion 20*a* and the third sheet portion 20*c* in the shielding state. For this reason, when the state of the shielding member 18 is changed from the retraction state to the shielding state, even when the rear surfaces of the first sheet portion 20*a* and the third sheet portion 20*c* contact the surface of the photosensitive drum 1, the electric discharge product can be prevented from being deposited on the surface of the image bearing member (the photosensitive drum) and therefore the image flow and the image blur can be prevented.

In this embodiment, as described above, ethylene vinyl acetate is used as the material for the shielding member 18 but such a material is liable to cause transfer of the deposited electric discharge product therefrom. Therefore, in the case where the surfaces of the second sheet portion 20b and the third sheet portion 20*c* on which the electric discharge product has been deposited in the shielding state contact the rear surfaces of the first sheet portion 20*a* and the third sheet portion 20*c* in the retraction state, the electric discharge product can be transferred onto the rear surfaces. Then, in the case where the rear surfaces contact the photosensitive drum 1 when the shielding member state is changed from the retraction state to the shielding state, there is a possibility that the electric discharge product deposited on the rear surfaces is deposited on the surface of the photosensitive drum 1 to cause the image flow and the image blur. On the other hand, in this embodiment, in the retraction state, the surfaces of the second sheet portion 20*b* and the third sheet portion 20*c* do not contact the rear surfaces of the first sheet portion 20*a* and the third sheet portion 20*c*, so that it is possible to prevent the occurrences of such problems. For this reason, in this embodiment, as the material for the shielding member 18, the material which is chemically stable and has the flame resistance can be used without concern for the transfer of the electric discharge product.

Further, in this embodiment, the deposition of the electric discharge product is prevented by the shielding means 18, so that there is no need to turn on the drum heater during the long-term rest and to perform an idling operation before image formation. For this reason, the image forming apparatus is excellent in economy and can shorten the FCOT.

Incidentally, in this embodiment, in order to pull the longitudinal central portion of the shielding member 18 by the winding-up means 22, the constitution in which the first sheet portion 20*a* is connected to the longitudinal central portion is employed but another structure can also be employed. For example, in place of the first sheet portion 20*a*, a string or a silkworm gut is fixed at the longitudinal central portion of the shielding member 18, and the shielding member 18 may also be wound up by the winding-up means 22 through the string or the silkworm gut. In this case, a portion corresponding to the second sheet portion 20*b* and the third sheet portion 20*c* is constituted by a single sheet.

In the above description, as the material for the shielding member 18, ethylene vinyl acetate is employed but in addition thereto, the following materials are usable. That is, as a resin material, it is possible to use polycarbonate; fluorine-containing resin (ETFE, PVDF); styrene-based resins (homopolymers or copolymers containing styrene or styrene substitution products) such as polystyrene, polyphenylene sulfide, chrolopolystyrene, poly-α-methylstyrene, styrene-butadiene copolymer, styrene-vinyl chloride copolymer, styrene-vinyl acetate copolymer, styrene-maleic acid copolymer, styrene-acrylate copolymer (styrene-methyl acrylate copolymer, styrene-ethyl acrylate copolymer, styrene-butyl acrylate copolymer, styrene-octyl acrylate copolymer, styrene-phenyl acrylate copolymer, etc.), styrene-methacrylate copolymer (styrene-methyl methacrylate copolymer, styrene-ethyl methacrylate copolymer, styrene-phenyl methacrylate copolymer, etc.), styrene-α-methyl chloroacrylate copolymer, and styrene-acrylonitrile-acrylate copolymer; methyl methacrylate resin; butyl methacrylate resin; ethylacrylate resin; butyl acrylate resin; modified acrylic resin (silicone-modified acrylic resin, vinyl chloride-modified acrylic resin, acrylic urethane resin, etc.); oxidized acrylic resin; vinyl chloride resin; styrene-vinyl acetate copolymer; vinyl chloride-vinyl acetate copolymer; rosin-modified maleic acid resin; phenolic resin; epoxy resin; polyester resin; polyester-polyurethane resin; polyethylene; polyethylene terephthalate; polypropylene; polybutadiene; polyvinylidene chloride; ionomer resin; polyurethane resin; silicone resin; ketone resin; ethylene-ethyl acrylate copolymer; xylene resin; polyvinyl butyral resin; polyamide resin; polyimide resin; modified polyphenylene oxide resin; and modified polycarbonate resin. One or two or more species selected from the above-described resin materials can be used but the resin material is not limited to the above materials.

Further, as an elastic material (elastic rubber or elastomer), it is possible to use butyl rubber, fluorine-containing rubber, acrylic rubber, EPDM, NBR, acrylonitrile-butadiene-styrene rubber, natural rubber, isoprene rubber, styrene-butadiene rubber, butadiene rubber, ethylene-propylene rubber, ethylene-propylene terpolymer, chloroprene rubber, chlorosulfonated polyethylene, chlorinated polyethylene, urethane rubber, syndiotactic-1,2-polybutadiene, epichlorohydrin-based rubber, silicone rubber, fluorocarbon rubber, polysulfide rubber, polynorbornene rubber, hydrogenated nitrile rubber, and thermoplastic elastomers (of, e.g., polystyrene type, polyorefin type, polyvinyl chloride type, polyurethane type, polyamide type, polyurea type, polyester type, and fluorine-containing resin type). One or two or more species selected from the above-described elastic materials can be used. However, the elastic material is not limited to the above material.

Further, as a metal material, it is possible to use gold, silver, copper, aluminum, nickel, titanium, titanium oxide, SUS, tin oxide, etc. These materials may be used in a thin film shape or may be deposited on the above-described resin materials or the above-described elastic materials. Further, the thin film of the metal material may be applied to the entire surface of or a part of the surface of the above-described resin materials or the above-described elastic materials. The metal material to be deposited or applied is not limited to those described above.

With the transition to the retraction state, the shielding member is retracted so that the surfaces, constituting a pair, of the portions obtained by longitudinally dividing the shielding member into a plurality of sections oppose each other, so that upsizing of the apparatus can be suppressed. Further, the charging means-side surface of the shielding member does not contact the photosensitive member-side rear surface of the shielding member in the shielding state. For this reason, even when the photosensitive member-side rear surface of the shielding member contacts the photosensitive member surface in the case where the state of the shielding member is changed from the retraction state to the shielding state, the electric discharge product can be prevented from being deposited on the surface of the image bearing member (the photosensitive member) and therefore it is possible to prevent the image flow and the image blur. Further, in the present invention, the deposition of the electric discharge product is prevented by the shielding means, so that there is no need to turn on the drum heater during the long-term rest or to perform the idling operation before the image formation. For this reason, the image forming apparatus is excellent in economy and can shorten the FCOT.

[Second Embodiment]

Second Embodiment of the present invention will be described with reference to FIGS. 7 to 10. Incidentally, in this embodiment, a structure of a shielding member 18*a* and a structure of a portion for retracting this shielding member 18*a* are different from those in First Embodiment. Other constitutions and functions are similar to those in First Embodiment, so that the different portions will be principally described below. The shielding member 18*a* in this embodiment is prepared by arranging a plurality of 0.1 mm-thick plates (sheets) 33 of polyethylene terephthalate (PET) on one of the surfaces of a sheet member 32 formed of a material similar to that used in First Embodiment. Incidentally, also with respect to these respective plates 33, the materials for the shielding member described above in First Embodiment can be appropriately selected and used. Each of the plates 33 has a length (width), with respect to the widthwise direction of the sheet member 32, which is equal to the length (width) of the sheet member 32. Further, with respect to the length of the sheet member 32 in the longitudinal direction of the sheet member 32, each of the plates 33 has the same length. Further, the respective plates 33 may be placed at regular intervals each with a slight spacing or placed at intervals with a change spacing every other interval. In either case, the plates 33 are fixed on the one surface of the sheet member 32 by bonding or the like so that the sheet member 32 can be bent or folded between adjacent plates 33. In this embodiment, portions among the adjacent plates 33 constitute a plurality of bending portions.

Figure 9:
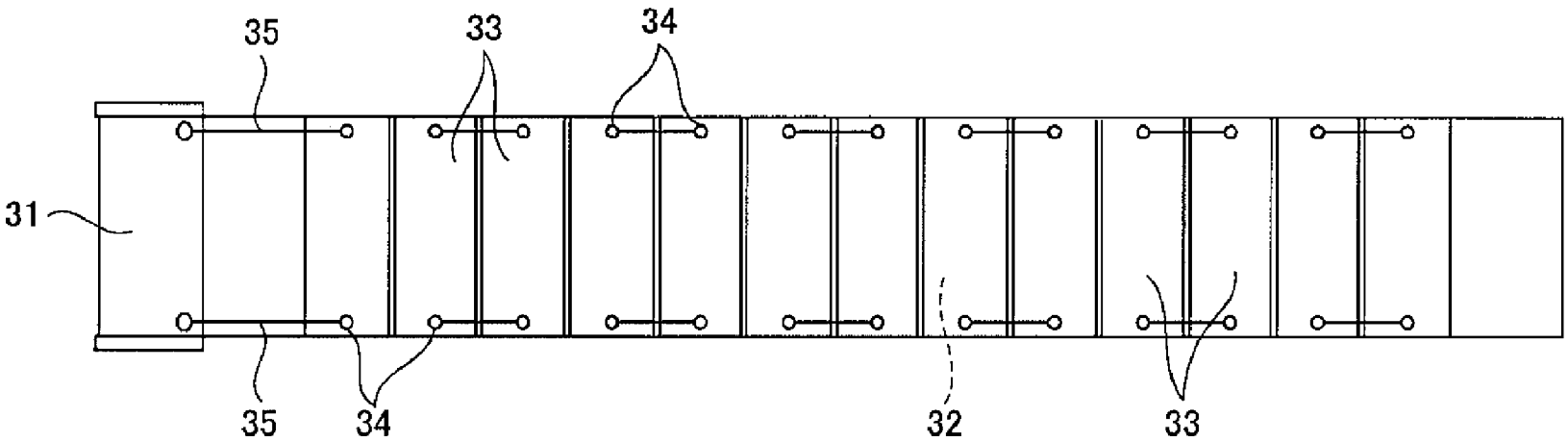
FIG. 9 is a plan view showing a retracting means and a shielding member.
Figure 10:
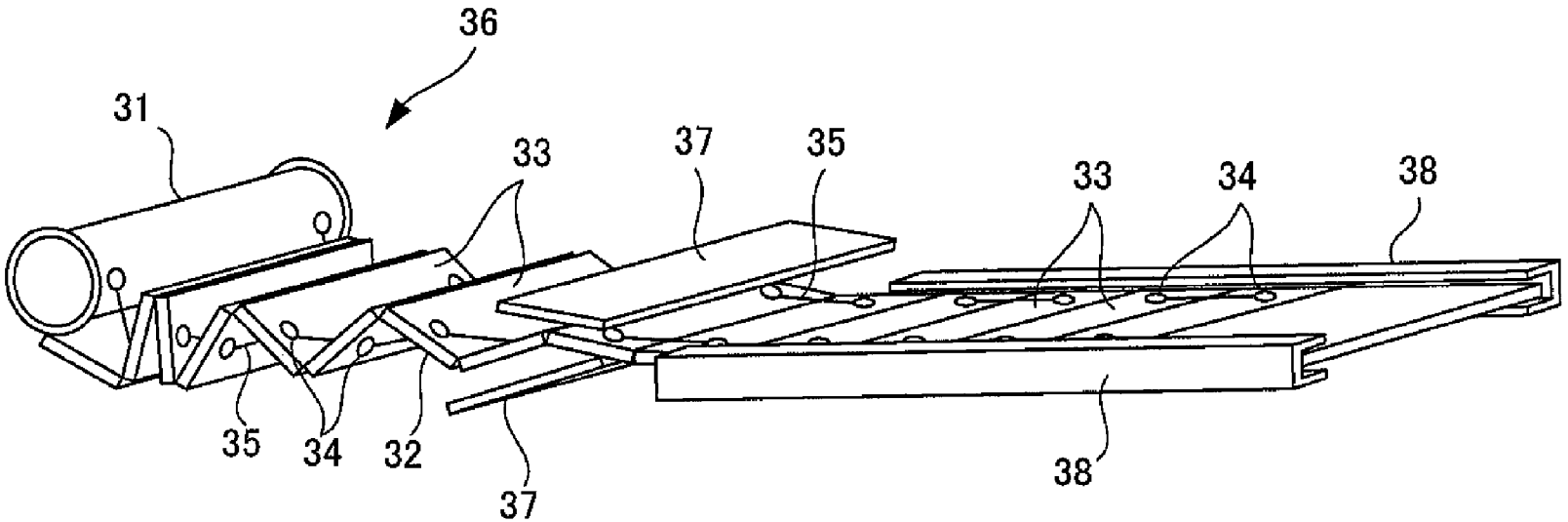
FIG. 10 is a perspective view showing the retracting means and the shielding member.

Further, at a central portion of each plate 33, with respect to the length direction of each plate 33 (left-right direction in FIG. 9), located, at each of both end portions with respect to the widthwise direction of each plate 33 (up-down direction in FIG. 9), a hole 34 is provided. Further, a hole is also provided at a position of the sheet member 32 corresponding to an associated one of the holes 34. However, the plate 33 located at the end of the sheet member 32 (the right end side in FIG. 9) is not provided with the hole 34. Further, two silkworm guts 35 are passed through the holes 34 in such a manner that each of the two silkworm guts 35 is extended in the longitudinal direction of the sheet member 32 while being alternately passed through the holes 34 on the same widthwise side from the front (upper) surface of the structure consisting of the plates 33 and the sheet member 32 to the rear (lower) surface of the structure or from the rear surface to the front surface, as shown in FIG. 9. The end of each of the silkworm guts 35 is fixed to the second plate 33 from the end of the sheet member 32 but is not to the first plate (end plate) 33 from the end of the sheet member 32. This end plate 33 is configured to stay on a rail 38 at least at a part thereof so that the shielding member 18*a* is not detached from the rail 38 during retraction thereof described later, so that there is no need to fix the silkworm guts 35 to the end plate 33. However, it is also possible to fix the silkworm guts 35 to the end plate 33. On the other hand, a base end of each of the silkworm guts 35 is fixed to the bobbin 31 constituting a retracting means 36. This bobbin 31 is rotatable by providing therein the power spring or by being driven by the motor. By the rotation of the bobbin 31, the silkworm guts 35 are wound up, so that the shielding member 18*a* is folded up while being bent at the portion between the adjacent plates 33.

Further, in this embodiment, a driving means 19*a* includes a movable means 21*a* for moving the end of the shielding member 18*a* between both longitudinal end portions of the charger 2 and includes a retracting means 36 for retracting the shielding member 18*a* into a portion located on one longitudinal end side outside the charger 2 while bending the shielding member 18*a* at each bending portion. The retracting means 36 includes a pair of guide portions 37 which are disposed outside the charger with respect to the longitudinal direction of the shielding member 18*a* (on the left side in FIGS. 7 and 9) and are disposed so that the guide portions 37 oppose each with respect to a thickness direction of the shielding member 18*a* and a gap between the guide portions 37 is gradually increased toward the bobbin 31. The gap between the guide portions 37 is slightly larger than a total thickness of the sheet member 32 and the plates 33 at a longitudinal end portion of the guide portions 37 (at the right end portion in FIGS. 7 and 9) and is larger than the length of the plates 33 in the length direction of the plates 33 at the other longitudinal end portion of the guide portion 37. Thus, the guide portions 37 prevent the shielding member 18*a* from being bent when the shielding member 18*a* passes through the longitudinal end portion of the guide portions 37, and permits the bending of the shielding member 18*a* when the shielding member 18*a* passes through the other longitudinal end portion of the guide portions 37.

Further, between the photosensitive drum 1 and the charger 2, the rail 38 is disposed and extended in the longitudinal direction at each of both end portions of the charger 2 with respect to the widthwise direction of the charger 2. These rails 38 are formed so as to open on their opposing sides. In each of the openings of the rails 38, the shielding member 18*a* is disposed at each of the both widthwise end portions of the shielding member 18*a*, so that movement of the shielding member 18*a* is guided. The length of each of the rails 38 is longer than the length of the opening of the casing 11 of the charger 2 with respect to the longitudinal direction of the opening, so that the opening of the casing 11 is covered with the shielding member 18*a* in a state in which the shielding member 18*a* is disposed in the rails 38 at the both widthwise direction thereof. Incidentally, the one longitudinal end portion of the rail 38 is located outside the associated end portion of the opening of the casing 11 so that a part of the end plate 33 of the shielding member 18 can be detached from the opening of the casing 11 even when the part remains in the rails 38 during the retraction of the shielding member 18*a*. Further, outside the one longitudinal end portion of the rails 38, the pair of guide portions 27 is disposed. Therefore, the guide portions 37 are located between the rails 38 and the bobbin 31.

Further, a movable means 21*a* is disposed opposed to the photosensitive drum 1 through the charger 2 and includes the movable member 24*a* to which the end of the shielding member 18*a* is fixed. Therefore, by the drive of the motor 23, the end of the shielding member 18*a* is moved in the longitudinal direction of the charger together with the movable member 24. Incidentally, in order to fix the arm portions 29 constituting the movable member 24 at the end of the shielding member 18*a*, through holes 39 are provided along the longitudinal direction at the both widthwise end portions of the casing 11 of the charger 2. That is, the arm portions 29 are passed through the through holes 39, so that the ends of the arm portions 29 can be disposed on the opening side of the casing 11. Further, the ends of the arm portions 29 are fixed on the end plate 33 located at the end portion of the shielding member 18*a*. As a result, the arm portions 29 can be disposed on the opening side of the casing 11 without interfering with the rails 38. However, so long as such an interference can be prevented, the arm portions 29 can also be disposed outside the casing 11 to omit the through holes 39. Further, recessed guide portions 40 are provided at both widthwise end portions of the movable member 24*a* and are engaged with rails 30 provided at positions spaced from the through holes 39 at the both widthwise end portions of the casing 11. By the engagement between the recessed guide portions 40 with the rails 30, longitudinal movement of the movable member 24*a* is guided.

In this embodiment, in the shielding state in which the gap between the photosensitive drum 1 and the charger 2 is shielded (covered) with the shielding member 18*a*, the end of the shielding member 18*a* is moved to the other end on the longitudinal end side of the charger 2 by the movable means 21*a*. At this time, the silkworm guts 35 are pulled out by rotating the bobbin 31 against the tension of the power spring, so that the shielding member 18*a* is pulled out from the retracting means 36. The respective plates 33 constituting the shielding member 18*a* are guided by the guide portions 37, thus being gradually developed from the bent state. Then, in a state in which the end of the shielding member 18*a* is located outside the associated longitudinal end portion of the opening of the casing 11 of the charger 2, the development of the shielding member 18*a* is completed. As a result, the surface of the shielding member 18*a* opposes the charger 2. Incidentally, in this state in this embodiment, the respective plates 33 provided on one surface of the sheet member 32 oppose the charger but a relationship between the front and rear surfaces may also be reversed.

Next, in the retraction state in which the shielding member 18*a* is retracted from the gap between the photosensitive drum 1 and the charger 2, the end of the shielding member 18*a* is moved to the other end on the associated longitudinal end portion side of the charger 2. At this time, the silkworm guts 35 are wound about the bobbin 31 by the tension of the power spring. Further, the shielding member 18*a* is moved along the rails 38 are passes through the end portion of the rails 38. Thereafter, the shielding member 18*a* is gradually bent at each bending portion while being guided by the guide portions 37. The bending direction at this time is regulated by the silkworm guts 35, so that the shielding member 18*a* is retracted in a state in which adjacent charger means-side surface portions, of the shielding member 18*a* defined as a plurality of sections by the respective bending portion so as to constitute pairs thereof, oppose each other. Specifically, the shielding member 18*a* is folded up in an accordion shape so that the surfaces of the adjacent plates 33 face each other. However, as described above, the end plate 33 located at the longitudinal end portion and the part of the sheet member 32 on which the end plate 33 is fixed stay on the rails 38, thus preventing the shielding member 18*a* from being detached from the rails 38 during the retraction. That is, in this embodiment, the shielding member 18*a* includes the plurality of defined (divided) portions so as to constitute the pairs at least from the longitudinal base end portion toward the (other) end portion, and the end portion does not constitute the pair and remains on the rails 38. In this way, in the case where the end of the shielding member 18*a* remains on the rails 38 during the retraction, the shielding member 18*a* is liable to be moved along the rails 38 when the shielding member 18*a* is developed in a subsequent operation.

In this embodiment, as described above, the shielding member 18*a* is placed in the state in which the surface portions thereof defined by the respective bending portions oppose (face) each other during the retraction, so that the front surface of the shielding member 18*a* and the rear surface of the shielding member 18*a* do not contact each other. On the other hand, when the state of the shielding member 18*a* is shifted to the shielding state, the end of the shielding member 18*a* is pulled out from the retracting means 36 by the movable means 21*a*. At this time, the shielding member 18*a* is developed so that the surfaces of the adjacent plates 33 are separated from each other and is then placed in the above-described shielding state. Thus, also when the shielding member 18*a* is pulled out from the retracting means 36, the front and rear surfaces of the shielding member 18*a* do not contact each other.

According to this embodiment, with the shift to the retraction state, the shielding member 18*a* is retracted so that the surface portions thereof defined by the bending portions oppose each other. For this reason, the upsizing of the image forming apparatus can be suppressed. Further, the front and rear surfaces of the shielding member 18*a* do not contact each other. For this reason, in the case where the state of the shielding member 18*a* is changed from the retraction state to the shielding state, even when the rear surface of the shielding member 18*a* contacts the surface of the photosensitive drum 1, the electric discharge product can be prevented from being deposited on the surface of the image bearing member (the photosensitive drum 1) and therefore it is possible to prevent the image flow and the image blur. Further, it is also possible to achieve the same effects as those described in First Embodiment.

Incidentally, the above-described shutter constitution may also be applied to the corona charger for the transfer and the like, in addition to the corona charger as the primary charger for electrically charging the photosensitive drum.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 144339/2009 filed Jun. 17, 2009, which is hereby incorporated by reference.

What is claimed is:

1. A charging device comprising:

a corona charger for electrically charging a photosensitive member;

a sheet member capable of covering and uncovering an opening of said corona charger, wherein said sheet member is divided, in its one end side, into a first sheet portion for shielding substantially a half of a region of the opening of said corona charger and a second sheet portion for shielding a remaining region of the opening; and a winding-up member for winding up said sheet member in a state in which the first sheet portion and the second sheet portion are superposed so that an opposing surface of the first sheet portion opposing said corona charger and an opposing surface of the second sheet portion opposing said corona charger face each other.

2. A device according to claim 1, further comprising a cleaning means, wherein said cleaning means and said sheet member are moved by receiving a driving force from a common driving source.

3. An image forming apparatus comprising:

a photosensitive member; and a charging device according to claim 1.

* * * * *